US006982608B2

(12) United States Patent
Shibayama

(10) Patent No.: US 6,982,608 B2
(45) Date of Patent: Jan. 3, 2006

(54) ISOLATOR SUITABLE FOR MINIATURIZATION

(75) Inventor: Takamitsu Shibayama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 58 days.

(21) Appl. No.: 10/780,174

(22) Filed: Feb. 17, 2004

(65) Prior Publication Data

US 2004/0160288 A1 Aug. 19, 2004

(30) Foreign Application Priority Data

Feb. 19, 2003 (JP) ..... 2003-040438

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

2002/0180550 A1 * 12/2002 Kawanami et al. ..... 333/1.1
2003/0080823 A1 * 5/2003 Komai et al. ..... 333/24.2
2003/0218513 A1 * 11/2003 Komai et al. ..... 333/1.1

FOREIGN PATENT DOCUMENTS

JP 2001-094311 6/2001

* cited by examiner

*Primary Examiner*—Stephen E. Jones
(74) *Attorney, Agent, or Firm*—Brinks Hofer Gilson & Lione

(57) ABSTRACT

An isolator suitable for miniaturization due to a reduction in the size of a capacitor is provided. The isolator includes a flat plate-shaped ferrite member 4, and first, second, and third central conductors 5, 6, and 7 arranged on different planes in a vertical direction with dielectric bodies sandwiched therebetween so that parts thereof cross each other in the vertical direction. The ferrite member 4 is of a rectangle with long sides 4*a* and short sides 4*b*. One of the central conductors is located on the long side 4*a* and is arranged so as to transverse the short surface of the ferrite member 4 at an oblique angle to the short sides 4*b*. Therefore, the length of the central conductor increases, thereby increasing the inductance component. As a result, it is possible to reduce the size of the capacitor for performing resonance and to thus miniaturize the isolator.

6 Claims, 6 Drawing Sheets

ISOLATOR SUITABLE FOR MINIATURIZATION

This application claims the benefit of priority to Japanese Patent Application No. 2003-040438 herein incorporated by reference.

BACKGROUND OF THE INVENTION

1. Field of the Invention

The present invention relates to an isolator applied to an antenna combiner.

2. Description of the Related Art

A conventional isolator will now be described with reference to the accompanying drawings. FIG. 8 is an exploded perspective view of a conventional isolator. FIG. 9 is a plan view of main parts of the conventional isolator. FIG. 10 is a development view of central conductors related to the conventional isolator.

The structure of the conventional isolator will now be described with reference to FIGS. 8 to 10. The conventional isolator includes a boxlike first yoke 51, a disc-like magnet 52 arranged in the first yoke 51, a flat plate-shaped ferrite member 53 arranged under the magnet 52, first, second, and third central conductors 54, 55, and 56 made of a metal plate, which are mounted to the ferrite member 53 at intervals of 120° and parts of which cross each other, a boxlike resin case 57 that holds the ferrite member 53, and a U-shaped second yoke 58 arranged under the resin case 57.

The ferrite member 53 is of a rectangle having two long sides 53*a* opposite to each other and two short sides 53*b* opposite to each other.

As illustrated in FIG. 10, the first, second, and third central conductors 54, 55, and 56 are formed by punching a metal plate and are formed to extend outward from a square earth 70 provided in the center.

The first, second, and third central conductors 54, 55, and 56 are divided into two by slits 54*a*, 55*a*, and 56*a* provided in their longitudinal directions, respectively. The first, second, and third central conductors 54, 55, and 56 also have conductors 54*b*, 55*b*, and 56*b*, each consisting of two streaks of conductors having the same width and parallel to each other, and first, second, and third ports 54*c*, 55*c*, and 56*c* provided at the ends of the conductors 54*b*, 55*b*, and 56*b*.

Further, the first, second, and third central conductors 54, 55, and 56 are arranged such that the earth 70 is first arranged on the bottom face of the ferrite member 53, and the first, second, and third central conductors 54, 55, and 56 are then bent along the side face and top face of the ferrite member 53.

Although not illustrated herein, the first, second, and third central conductors 54, 55, and 56 located on the top face of the ferrite member 53 are arranged in a vertical direction in a state of being insulated from each other by dielectric bodies.

When the first, second, and third central conductors 54, 55, and 56 are mounted to the ferrite member 53, the first and second central conductors 54 and 55 are located on the short sides 53*b* and are arranged to cross the long surface of the ferrite member 53. The third central conductor 56 is located on the long side 53*a* and is arranged so as to transverse the short surface of the ferrite member 53 parallel to the short side 53*b*.

Further, the resin case 57 is provided with a bottom wall 57*b* having a hole 57*a*. Input and output terminals 59 and 60 and an earth terminal 61 are buried in the bottom wall 57*b* in a state where parts thereof are exposed to the outsides of the bottom wall 57*b* and the resin case 57.

The ferrite member 53 to which the first, second, and third central conductors 54, 55, and 56 are attached is arranged in the hole 57*a* so that the earth 70 at one end of each of the first, second, and third central conductors 54, 55, and 56 is connected to the second yoke 58.

Chip-type capacitors 62, 63, and 64 and a chip-type resistor 65 are arranged around the hole 57*a* so that electrodes on the bottom faces of the capacitors 62, 63, and 64 and an electrode 65*a* at one end of the resistor 65 are connected to the earth terminal 61.

The ports 54*c* and 55*c* of the first and second central conductors 54 and 55 are soldered to electrodes on the top faces of the capacitors 62 and 63. Further, the port 56*c* of the third central conductor 56 is connected to an electrode on the top face of the capacitor 64 and the top face of an electrode 65*b* at the other end of the resistor 65 by soldering.

The first and second yokes 51 and 58 are combined with each other in a state where the magnet 52, the ferrite member 53, and the resin case 57 are sandwiched between the first yoke 51 and the second yoke 58 so that a magnetic closed circuit is formed by the first and second yokes 51 and 58. Therefore, an isolator is formed (For example, refer to the Patent Document 1).

However, since the third central conductor 56 of a conventional isolator is provided on the long side 53*a* and is arranged so as to transverse the short surface of the ferrite member 53 parallel to the short sides 53*b*, the third central conductor 56 has a small inductance component. Therefore, it is necessary to increase the size of the capacitor 64 and to thus increase the size of the isolator.

[Patent Document 1]

Japanese Unexamined Patent Application Publication No. 2001-94311

In a conventional isolator, since the third central conductor 56 is provided on the long side 53*a* and is arranged so as to transverse the short surface of the ferrite member 53 parallel to the short sides 53*b*, the length of the third central conductor 56 is reduced. Therefore, the third central conductor 56 has a small inductance component. As a result, it is necessary to increase the size of the capacitor 64 and to thus increase the size of the isolator.

SUMMARY OF THE INVENTION

Embodiments of the present invention is to provide an isolator suitable for miniaturization due to a reduction in the size of a capacitor.

As first means for achieving the object, there is provided an isolator, comprising a flat plate-shaped ferrite member, first, second, and third central conductors located on the ferrite member on different planes in a vertical direction with dielectric bodies sandwiched therebetween so that parts thereof cross each other in the vertical direction, a magnet arranged on the central conductors, a first yoke arranged so as to cover the magnet, and a second yoke arranged on the bottom face of the ferrite member to constitute a magnetic closed circuit together with the first yoke. The ferrite member is of a rectangle with long sides and short sides. One of the central conductors is located on the long side and is arranged so as to transverse the short surface of the ferrite member at an oblique angle to the short sides.

Further, as second means for achieving the object, the central conductor arranged so as to transverse the short surface of the ferrite member is longitudinally divided to form first and second conductors.

Further, as third means for achieving the object, the first and second conductors are formed so as to have different angles so that the first and second conductors are not parallel to each other.

Further, as fourth means for achieving the object, the first and second conductors are arranged so as to be oriented at different angles with respect to the short sides.

Further, as fifth means for achieving the object, the first and second conductors have different widths.

Further, as sixth means for achieving the object, ports are provided at the ends of the first and second conductors, and a resistor and a capacitor are connected to the ports.

Further, as seventh means for achieving the object, the isolator comprises the first and second central conductors located on the short sides of the ferrite member and the third central conductor provided on the long side. The first and second central conductors are arranged so as to transverse the long surface of the ferrite member, and the third central conductor is arranged so as to transverse the short surface. Therefore, it is possible to reduce the size of the capacitor for performing resonance and to thus miniaturize the isolator.

Further, as eighth means for achieving the object, the isolator comprises cut-away portions provided at the corners of the ferrite member, the first and second central conductors located in the cut-away portions, and the third conductor located on the long side. The first and second central conductors located in the cut-away portions cross the ferrite member between the diagonally opposite cut-away portions, and the third central conductor is arranged to transverse the short surface.

DESCRIPTION OF THE PREFERRED EMBODIMENT

Figure 1:
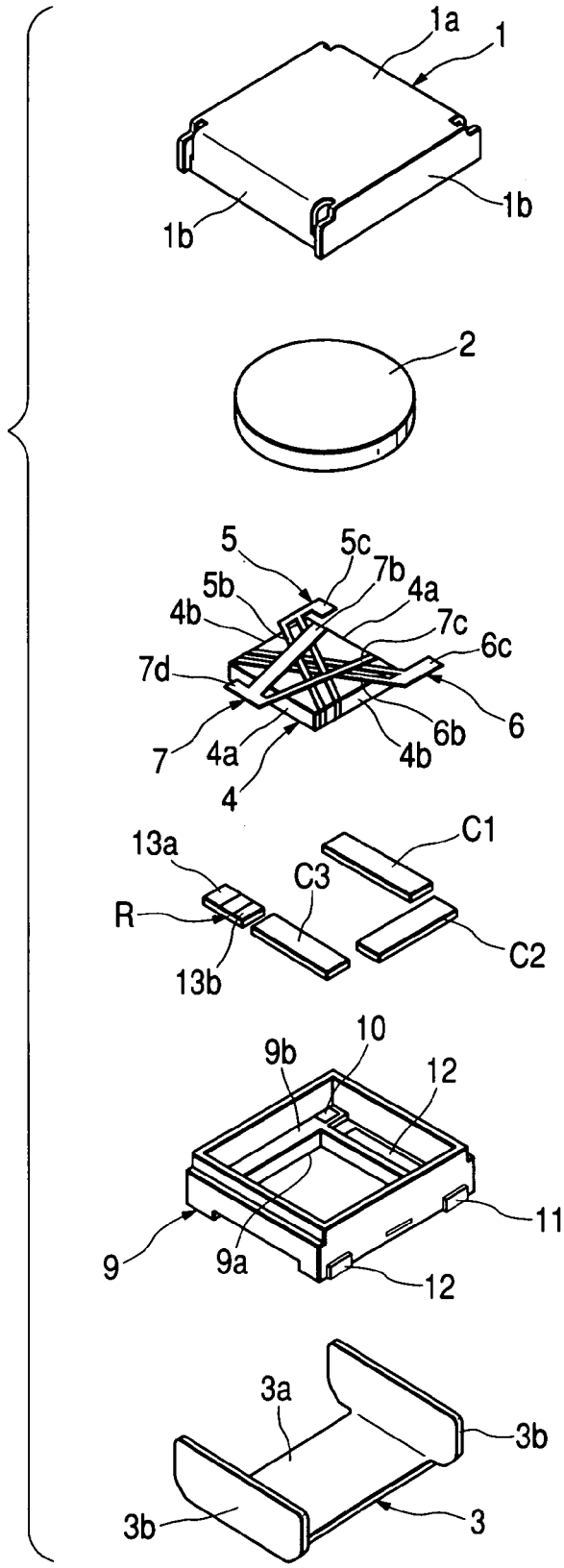
FIG. 1 is an exploded perspective view of an isolator according to a first embodiment of the present invention.
Figure 2:
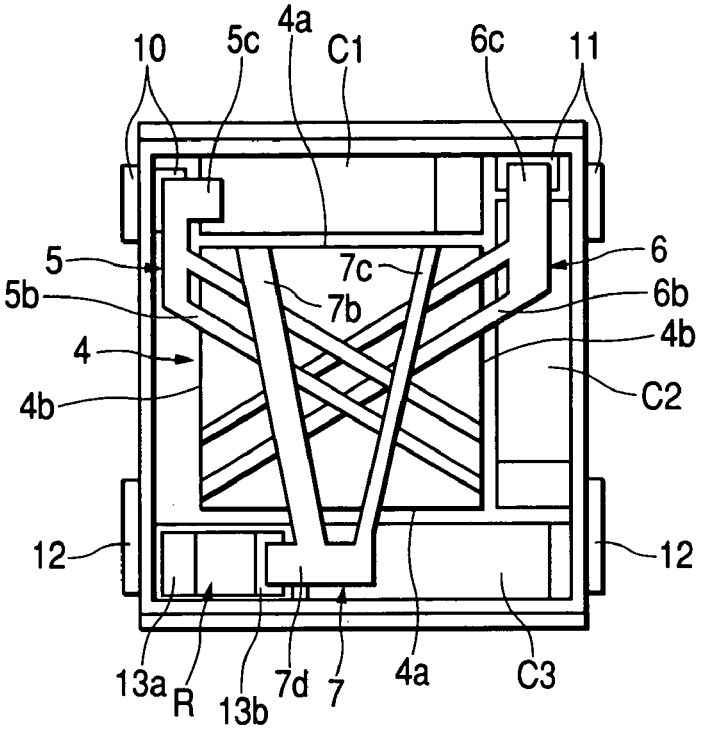
FIG. 2 is a plan view of main parts of the isolator according to the first embodiment of the present invention.
Figure 3:
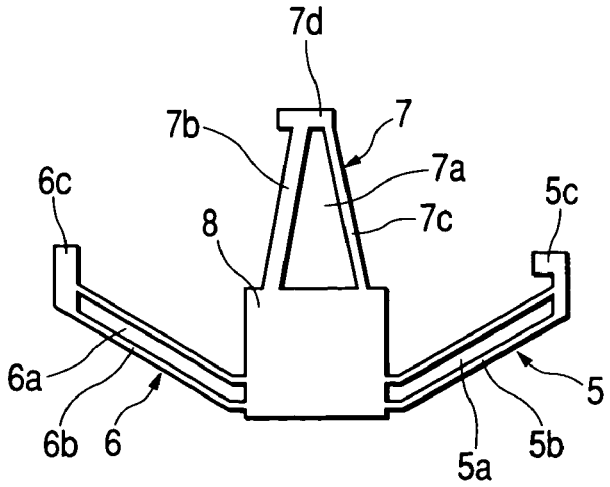
FIG. 3 is a development view of central conductors of the isolator according to the first embodiment of the present invention.

An isolator according to the present invention will now be described. FIG. 1 is an exploded perspective view of an isolator according to a first embodiment of the present invention. FIG. 2 is a plan view of main parts of the isolator according to the first embodiment of the present invention. FIG. 3 is a development view of central conductors of the isolator according to the first embodiment of the present invention.

Figure 4:
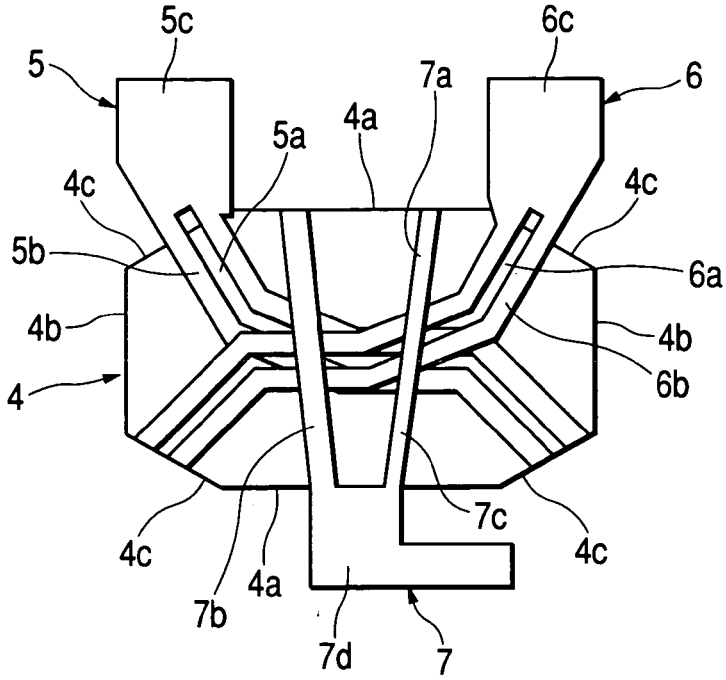
FIG. 4 is an enlarged plan view of main parts of an isolator according to a second embodiment of the present invention.
Figure 5:
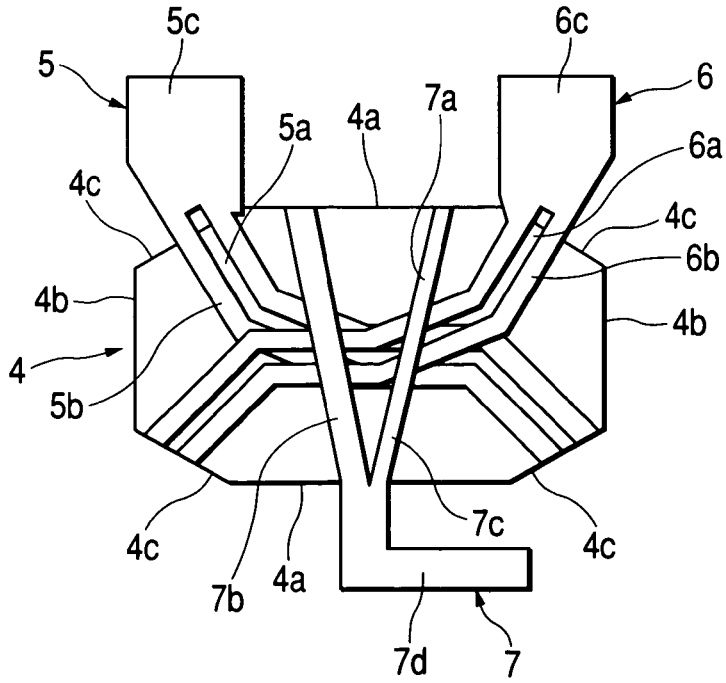
FIG. 5 is an enlarged plan view of main parts of an isolator according to a third embodiment of the present invention.
Figure 6:
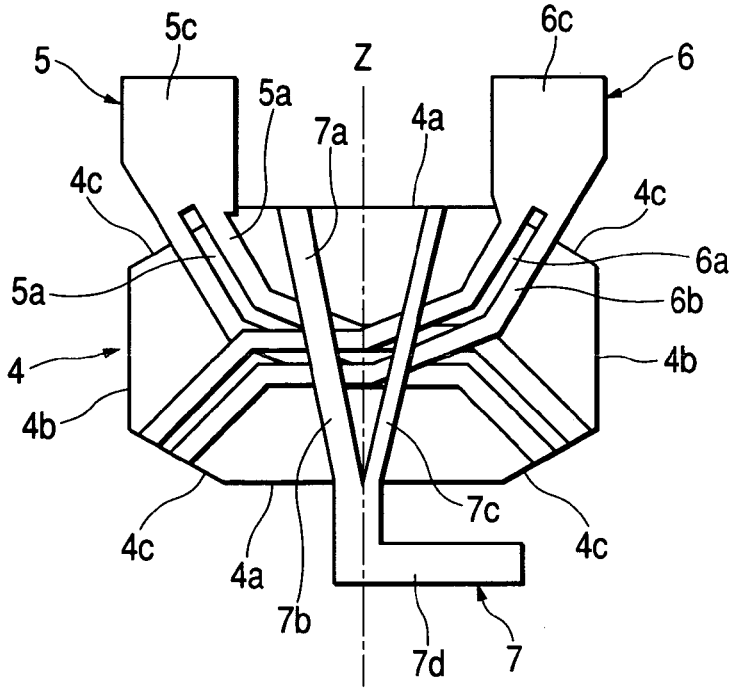
FIG. 6 is an enlarged plan view of main parts of an isolator according to a fourth embodiment of the present invention.
Figure 7:
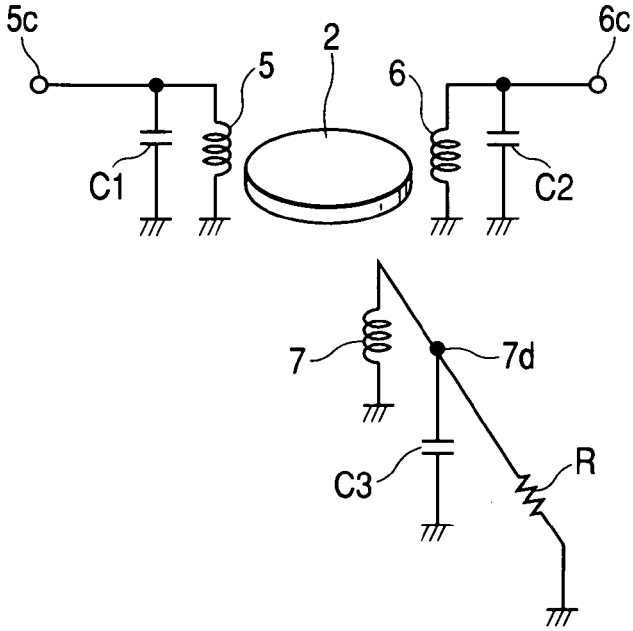
FIG. 7 is an equivalent circuit diagram of an isolator according to the present invention.
Figure 8:
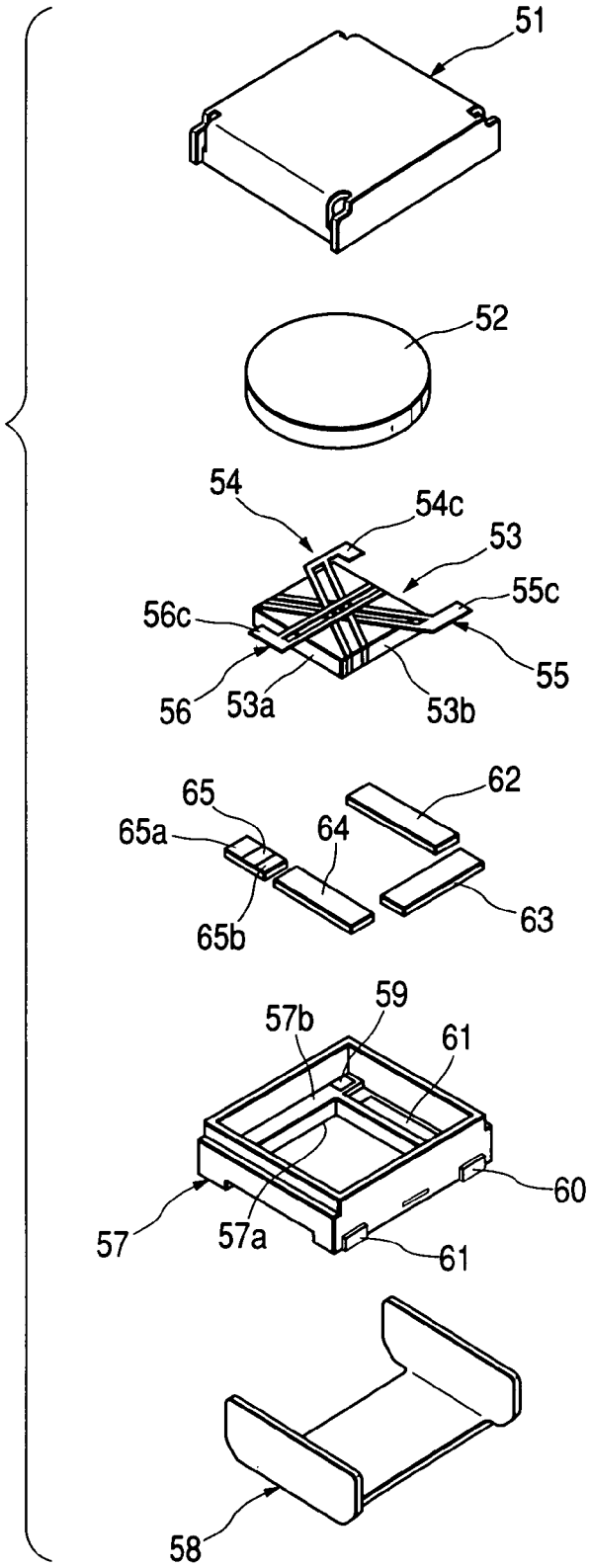
FIG. 8 PRIOR ART
FIG. 8 is an exploded perspective view of a conventional isolator.
Figure 9:
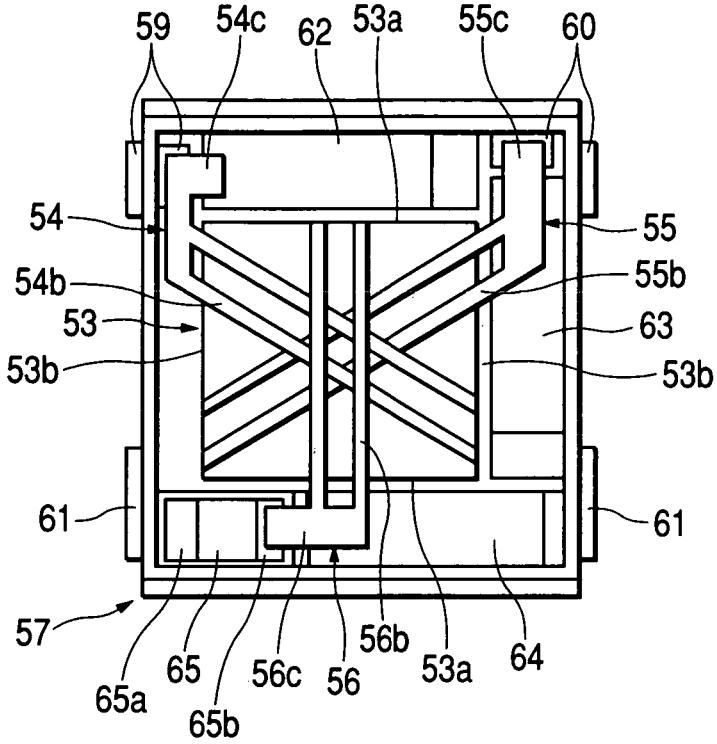
FIG. 9 PRIOR ART
FIG. 9 is a plan view of main parts of the conventional isolator.
Figure 10:
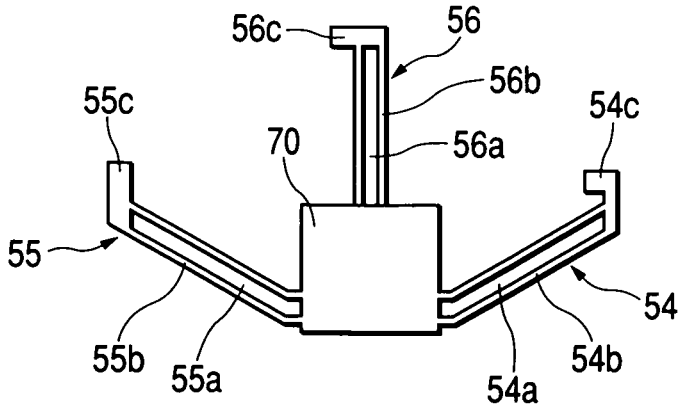
FIG. 10 PRIOR ART
FIG. 10 is a development view of central conductors of the conventional isolator.

FIG. 4 is an enlarged plan view of main parts of an isolator according to a second embodiment of the present invention. FIG. 5 is an enlarged plan view of main parts of an isolator according to a third embodiment of the present invention. FIG. 6 is an enlarged plan view of main parts of an isolator according to a fourth embodiment of the present invention. FIG. 7 is an equivalent circuit diagram of the isolator according to the present invention.

The structure of the isolator according to the first embodiment of the present invention will now be described with reference to FIGS. 1 to 3. A first yoke 1 made of a boxlike magnetic plate (iron plate) has a square top plate 1*a* and side plates 1*b* bent downward from the four sides of the top plate 1*a*.

A disc-like magnet 2 is mounted on the first yoke 1 by appropriate means in a state where the top face thereof comes in contact with the inside of the top plate 1*a*.

A second yoke 3 made of a U-shaped magnetic plate (iron plate) has a rectangular bottom plate 3*a* and a pair of opposite side plates, which are bent upward from the opposite sides of the bottom plate 3*a*.

The second yoke 3 is arranged such that the pair of side plates 3*b* thereof are combined with the pair of side plates 1*b* of the first yoke 1 in a state where the bottom plate 3*a* thereof face the top plate 1*a*, thereby forming a magnetic closed circuit.

A flat plate-shaped ferrite member 4 made of yttrium iron garnet (YIG) or the like is of a rectangle having two long sides 4*a* that face each other and two short sides 4*b* that face each other.

As illustrated in FIG. 3, first, second, and third central conductors 5, 6, and 7 made of thin conductive plates such as copper plates are formed by punching a metal plate having holes and are formed to extend outward from a central rectangular earth 8.

The first and second central conductors 5 and 6 are divided into two by slits 5*a* and 6*a* provided in their longitudinal directions. The first and second central conductors 5 and 6 also has conductors 5*b* and 6*b*, each consisting of two streaks of conductors having the same width and parallel to each other, and first and second ports 5*c* and 6*c* provided at the ends of the conductors 5*b* and 6*b*.

Further, the third central conductor 7 is divided into two by a substantially V-shaped slit 7*a* provided in its longitudinal direction. The third central conductor 7 also has two streaks of first and second conductors 7*b* and 7*c* with different widths in a state where the pair of conductors 7*b* and 7*c* are not parallel to each other, and a third port 7*d* provided at the ends of the first and second conductors 7*b* and 7*c*.

Further, the first, second, and third central conductors 5, 6, and 7 are arranged such that the earth 8 is first arranged on the bottom face of the ferrite member 4 and the first, second, and third central conductors 5, 6, and 7 are bent along the sides and the top face of the ferrite member 4.

At this time, the first, second, and third central conductors 5, 6, and 7 are provided on different planes in a vertical direction at intervals of 120° with dielectric bodies (not illustrated) sandwiched therebetween so that parts thereof cross each other in the vertical direction.

When the first, second, and third central conductors 5, 6, and 7 are mounted on the ferrite member 4, the first and second central conductors 5 and 6 are located on the short sides 4*b* of the ferrite member 4 and are arranged to transverse the long surface of the ferrite member 4. Further, the third central conductor 7 is located on the long side 4*a* of the ferrite member 4 and is arranged to transverse the short surface of the ferrite member 4 at an oblique angle to the short sides 4*b*.

That is, since the first and second conductors 7*b* and 7*c* of the central conductor 7 are arranged so as to transverse the short surface of the ferrite member 4 at an oblique angle to the short sides 4*b* of the ferrite member 4, the length of the third central conductor 3 arranged so as to transverse the short surface of the ferrite member 4 increases compared to the conventional configuration. Therefore, it is possible to increase the inductance component.

Further, a resin case 9 is provided with a bottom wall 9*b* having a hole 9*a*. Further, input and output terminals 10 and 11 and an earth terminal 12 are buried in the bottom wall 9*b* in a state where parts thereof are exposed to the outsides of the bottom wall 9*b* and the resin case 9.

When the ferrite member 4 to which the first, second, and third central conductors 5, 6, and 7 are attached is arranged in the hole 9*a*, the earth 8 at one end of each of the first, second, and third central conductors 5, 6, and 7 is connected to the bottom wall 3*b* of the second yoke 3 arranged under the resin case 9.

Chip-type first, second, and third capacitors C1, C2, and C3 and a chip-type resistor R are arranged around the hole 9*a* so that electrodes on the bottom faces of the first, second, and third capacitors C1, C2, and C3 and an electrode 13*a* at one end of the resistor R are connected to the earth terminal 12.

The first and second ports 5*c* and 6*c* of the first and second central conductors 5 and 6 are soldered to electrodes on the top faces of the first and second capacitors C1 and C2. Further, the third port 7*d* of the third central conductor 7 is connected to an electrode on the top face of the third capacitor C3 and the top face of an electrode 13*b* at the other end of the resistor R by soldering.

The first and second yokes 1 and 3 are combined with each other in a state where the magnet 2, the ferrite member 4, and the resin case 9 are sandwiched between the first yoke 1 and the second yoke 3 so that a magnetic closed circuit is formed by the first and second yokes 1 and 3. As a result, an isolator is formed.

FIG. 7 illustrates an equivalent circuit diagram of the isolator according to the present invention. The first and second ports 5*c* and 6*c*, serving as input and output terminals, to which the grounded first and second capacitors C1 and C2 are connected, are provided at one end of each of the first and second central conductors 5 and 6. Further, the third port 7*d* to which the ground third capacitor C3 and resistor are connected is provided at one end of the third central conductor 7.

The other ends of the first, second, and third central conductors 5, 6, and 7 are grounded by the earth 8.

In the above embodiment, the widths of the first and second conductors 7*b* and 7*c* of the third central conductor 7 are different from each other. However, the widths of the first and second conductors 7*b* and 7*c* of the third central conductor 7 may be equal to each other.

Further, the first and second conductors 7*b* and 7*c* are not parallel to each other. However, the first and second conductors 7*b* and 7*c* may be parallel to each other.

Further, in the above embodiment, the third central conductor 7 consists of two streaks of first and second conductors 7*b* and 7*c*. However, the third central conductor 7 may consist of one streak of band-shaped conductor.

FIG. 4 illustrates the structure of an isolator according to a second embodiment of the present invention. The second embodiment will now be described. Cut-away portions 4*c* are provided at the corners of the rectangular ferrite member 4. The first and second central conductors 5 and 6 are arranged to transverse the ferrite member 4 between the cut-away portions 4*c* diagonally opposite to each other in a state of being located in the cut-away portions 4*c*. The third central conductor 7 is arranged on the long side 4*a* so as to transverse the short surface.

The conductors 5*b* and 6*b* of the first and second central conductors 5 and 6 are curved. Further, the first and second ports 5*c* and 6*c* provided at the ends of the first and second central conductors 5 and 6 are arranged along one long side 4*a*. The first and second conductors 7*b* and 7*c* of the third central conductor 7 are formed such that the distance therebetween is slightly larger.

FIG. 5 illustrates the structure of an isolator according to a third embodiment of the present invention. The third embodiment will now be described. Cut-away portions 4*c* are provided at the corners of the rectangular ferrite member 4. The first and second central conductors 5 and 6 are arranged in the cut-away portions 4*c* so as to transverse the ferrite member 4 between the cut-away portions 4*c* diagonally opposite to each other. Further, the third central conductor 7 is arranged on the long side 4*a* so as to transverse the short surface.

The conductors 5*b* and 6*b* of the first and second central conductors 5 and 6 are curved. Further, the first and second ports 5*c* and 6*c* provided at the ends of the first and second central conductors 5 and 6 are arranged along one long side 4*a*. The first and second conductors 7*b* and 7*c* of the third central conductor 7 are formed such that the distance therebetween is slightly smaller.

FIG. 6 illustrates an isolator according to a fourth embodiment of the present invention. The fourth embodiment will now be described. The first and second conductors 7*b* and 7*c* of the third central conductor 7 are formed such that the distance therebetween is slightly smaller. The first and second conductors 7*b* and 7*c* are arranged so as to have different inclinations with respect to a central line Z.

Accordingly, the first and second conductors 7*b* and 7*c* are arranged so as to have different inclinations with respect to the short side 4*b* of the ferrite member 4.

Other structure of the isolator according to the fourth embodiment is the same as the structure of the third embodiment excluding the above. The same parts are denoted by the same reference numerals. Therefore, detailed description thereof will be omitted.

The impedances of the first central conductor 5 and the second central conductor 6 are determined by the distances from the ferrite member 4 to the first central conductor 5 and the second central conductor 6 in the direction of the thickness of the ferrite member 4 and the angle at which the port of the first central conductor 5 or the second central conductor 6 crosses the third central conductor 7.

When the first, second, and third central conductors 5, 6, and 7 sequentially cross each other on the ferrite member 4, the distance between the ferrite member 4 and the first central conductor 5 is smaller than the distance between the ferrite member 4 and the second central conductor 6. Therefore, the inductance increases, thereby increasing the impedance of the first central conductor 5.

When the angles at which the first central conductor 5 and the second central conductor 6 cross the third central conductor 7 are equal to each other, the impedance of the first central conductor 5 is different from the impedance of the second central conductor 6.

As described in the fourth embodiment, it is possible to control the impedance by changing the angle at which the first and second conductors 7*b* and 7*c* of the third central conductor 7 face each other thereby changing the angle at which the port of the first central conductor 5 crosses the first conductor 7*b* of the third central conductor 7 and the angle at which the port of the second central conductor 6 crosses the second conductor 7*c* of the third central conductor 7.

The isolator according to the present invention includes a flat plate-shaped ferrite member, first, second, and third central conductors located on the ferrite member on different planes in a vertical direction with dielectric bodies sandwiched therebetween so that parts thereof cross each other in the vertical direction, a magnet arranged on the central conductors, a first yoke arranged to cover the magnet, and a second yoke arranged on the bottom face of the ferrite member so as to constitute a magnetic closed circuit together with the first yoke. The ferrite member is of a rectangle with long sides and short sides. One of the central conductors is located on the long side and is arranged so as to transverse the short surface of the ferrite member at an oblique angle to the short sides.

As mentioned above, one of the central conductors is located on the long side and is arranged so as to transverse the short surface of the ferrite member at an oblique angle to the short sides. Thus, the length of the central conductor increases, thereby increasing the inductance component thereof. As a result, it is possible to reduce the size of the capacitor for performing resonance and to thus miniaturize the isolator.

Further, the central conductor arranged so as to transverse the short surface of the ferrite member is longitudinally divided to form first and second conductors. Thus, it is possible to secure a well-balanced position in consideration of the positions of the other two central conductors.

Further, the first and second conductors are arranged so as to be oriented at different angles with respect to the short sides. Thus, it is possible to control the angles of the central conductors, respectively. As a result, it is possible to correct the difference in the impedances due to the difference in the lengths of the central conductors when the three central conductors cross each other.

Further, the first and second conductors have different widths. Thus, it is possible to increase the width of one conductor. As a result, it is possible to increase the bending strength of the central conductor.

Further, the ports are provided at the ends of the first and second conductors, and the resistor and the capacitor are connected to the ports. Thus, it is possible to reduce the size of the capacitor for performing resonance and to obtain an appropriate isolator.

Further, the isolator comprises the first and second central conductors located on the short sides of the ferrite member and the third central conductor provided on the long side. The first and second central conductors are arranged so as to transverse the long surface of the ferrite member, and the third central conductor is arranged so as to transverse the short surface. Thus, it is possible to reduce the size of the capacitor for performing resonance and to miniaturize the isolator.

Further, the isolator comprises cut-away portions provided at the corners of the ferrite member, the first and second central conductors located in the cut-away portions, and the third conductor located on the long side. The first and second central conductors located in the cut-away portions cross the ferrite member between the diagonally opposite cut-away portions, and the third central conductor is arranged to transverse the short surface. Thus, it is possible to reduce the size of the capacitor for performing resonance and to thus miniaturize the isolator.

What is claimed is:

1. An isolator, comprising:

a flat plate-shaped ferrite member;

first, second, and third central conductors located on the ferrite member on different planes in a vertical direction with dielectric bodies sandwiched therebetween so that parts thereof cross each other in the vertical direction;

a magnet arranged on the central conductors;

a first yoke arranged so as to cover the magnet; and a second yoke arranged on the bottom face of the ferrite member to constitute a magnetic closed circuit together with the first yoke, wherein the ferrite member is substantially rectangular-shaped having long sides and short sides, and wherein one of the central conductors contacts one of the long sides and is arranged transverse to a short surface of the ferrite member at an oblique angle to the short sides, and is longitudinally divided to form first and second conductors, the first and second conductors having different widths.

2. The isolator according to claim 1, wherein ports are provided at the ends of the first and second conductors, and a resistor and a capacitor are connected to the ports.

3. The isolator according to claim 1, comprising:

the first and second central conductors contacting the short sides of the ferrite member; and the third central conductor contacting one of the long sides, wherein the first and second central conductors are arranged so as to transverse a long surface of the ferrite member, and wherein the third central conductor is arranged transverse to the short surface.

4. The isolator according to claim 1, comprising:

diagonally cut-away portions provided at corners of the ferrite member, the first and second central conductors contacting the cut-away portions, and the third conductor contacting one of the long sides, wherein the first and second central conductors contacting the cut-away portions cross the ferrite member between the diagonally opposite cut-away portions, and wherein the third central conductor is arranged transverse to the short surface.

5. The isolator according to claim 1, wherein the first and second conductors are formed so as to have different angles so that the first and second conductors are not parallel to each other.

6. The isolator according to claim 5, wherein the first and second conductors are arranged so as to be oriented at different angles with respect to the short sides.

* * * * *